United States Patent [19]

Hunziker

[11] Patent Number: 4,564,316

[45] Date of Patent: Jan. 14, 1986

[54] FACE PANEL SYSTEM

[76] Inventor: Kenneth J. Hunziker, Rte. 3, Box 715, Yakima, Wash. 98901

[21] Appl. No.: 439,778

[22] Filed: Nov. 8, 1982

[51] Int. Cl.[4] ..... E02D 29/02

[52] U.S. Cl. ..... 405/262; 264/31; 405/116; 405/284

[58] Field of Search ..... 405/116, 117, 262, 272, 405/284, 285, 286, 287; 249/10, 20, 23, 25; 264/31, 33, 35; 425/63, 65

[56] References Cited

U.S. PATENT DOCUMENTS

| | | | |
|---|---|---|---|
| 1,044,862 | 11/1912 | Crary | 249/10 |
| 1,762,343 | 6/1930 | Munster . | |
| 1,806,255 | 5/1931 | Groner et al. . | |
| 2,879,647 | 3/1959 | Hayden . | |
| 2,902,743 | 9/1959 | King | 405/284 X |
| 2,962,789 | 12/1960 | Williams | 249/10 |
| 3,282,054 | 11/1966 | Saginor . | |
| 3,342,033 | 9/1967 | Crouch et al. . | |
| 3,464,211 | 9/1969 | Andresen | 405/262 |
| 3,891,731 | 6/1975 | Williams | 264/33 |
| 3,922,864 | 12/1975 | Hilfiker . | |
| 4,067,166 | 1/1978 | Sheahan . | |
| 4,324,508 | 4/1982 | Hilfiker et al. | 405/284 |
| 4,329,089 | 5/1982 | Hilfiker et al. | 405/262 |

*Primary Examiner*—David H. Corbin
*Attorney, Agent, or Firm*—Dowrey & Cross

[57] ABSTRACT

A face panel system for forming an exposed face on a fill structure employs a succession of precast reinforced concrete panels which act first as a restraining form and then as a permanent exposed face for the structure. In one embodiment, successively higher rows of panels are supported by strongbacks mounted to a lower row of panels and extending upward therefrom to act as temporary cantilevered supports for the next higher row. In this manner, horizontal forces exerted by the fill mass are transferred back to the mass. Another embodiment features an internal cantilever support structure embedded in the panels, which are coupled together with brackets extending therefrom.

13 Claims, 16 Drawing Figures

FIG. 1
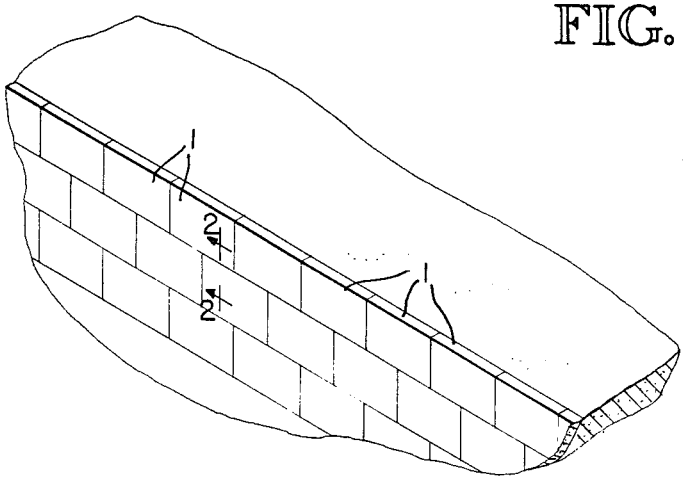
FIG. 4
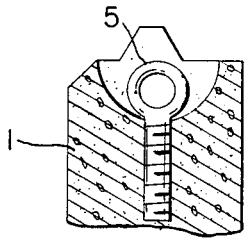
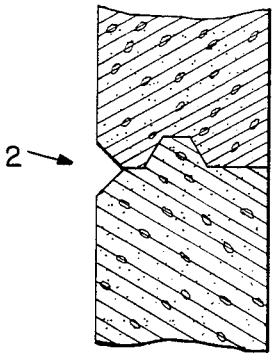
FIG. 2
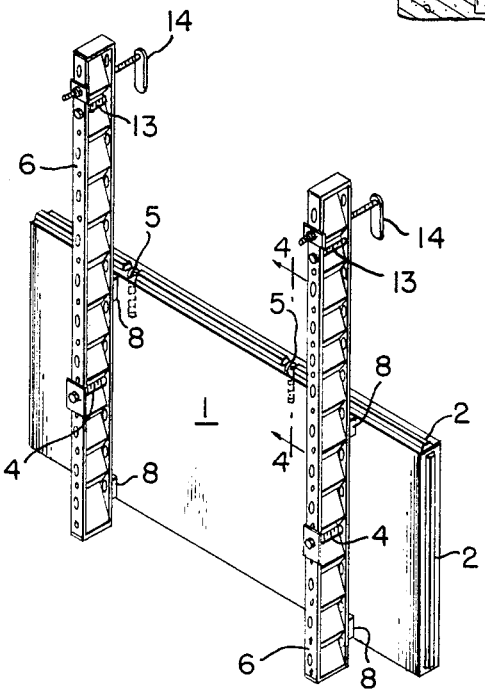
FIG. 3

FACE PANEL SYSTEM

BACKGROUND OF THE INVENTION

1. Field of the Invention

This invention relates to methods and apparatus for constructing fill structures such as retaining walls, dams, and the like. More particularly, the invention is directed to a method and apparatus for constructing an exposed face, suitable for use as the visible surface of such structures which may be composed of any of a variety of materials, as, for example, Portland cement concrete, roller compacted concrete, cement treated soil and the like. The face panel system of the invention also acts as a restraining form for the mass as it is being constructed.

2. Description of the Prior Art

Prior art systems for constructing dams and the like are quite costly. One system involves the construction of climbing form walls, which necessitates the time consuming transporting of formwork to and from the job site, and the setting up of the formwork, followed by the stripping of forms after the concrete has set. After this is done, the exposed concrete must be finished, and snapties broken back and patched to produce an acceptably smooth surface. Climbing form walls of this type may not be appropriate, or may be highly inefficient, in use with some cementitious materials.

Another system for constructing a wall for use in a dam or the like is that shown in U.S. Pat. No. 3,686,873 to Vidal. This system, however, is uniquely designed to create stability in a noncementitious fill by the use of heavy and expensive cladding panels and reinforcing straps which must extend a minimum of fourteen feet at the top of a wall and increase considerably in length toward the base of the wall. Such prior art systems necessitate great expense in terms of labor and materials.

Structural stability and safety is also a problem in the prior art, since cladding panels may not be totally secure immediately after placement. Also, provision of a personnel safety barrier introduces extra costs for scaffolding and the like to support workers.

SUMMARY OF THE INVENTION

In a system according to the present invention, considerable savings in both labor and materials are realized by the use of a panel system which eliminates the need for transporting and manipulating temporary form walls. No snapties are needed, and the panels, which act as a form to contain the concrete or other material, also remain on the structure to act as an aesthetically pleasing and structurally sound exposed surface.

Alignment, plumbing and securing of the panels according to the present invention are easily accomplished. Thus, verticality of a structure is easily maintained. No specialized equipment is needed to place the panels, and the simplicity of the system greatly reduces the amount of time and labor needed for fabrication of a structure, greatly reducing the cost of construction from that incurred by the use of prior art systems.

In addition, one embodiment of the face panel system of the present invention can be used to provide an improved and inexpensive personnel safety barrier.

In the embodiments disclosed, the face panel system of the invention employs a succession of precast reinforced concrete panels which act first as a restraining form and then as a permanent exposed face for a cementitious structure composed of Portland cement concrete, roller compacted concrete, cement treated soil or the like.

In the preferred embodiment, a series of panels are set in a first horizontal row, and are temporarily supported there while cementitious material is filled in behind the row. Tiebacks are threaded through the back of the panels to mechanically bond the panels to the cementitious mass. The temporary supports are then removed, and the face panels become a free-standing facing wall. In this system, successively higher rows of panels are supported in a novel manner by low rows of panels. Strongbacks mounted to a lower row of panels and extending upward therefrom act as unique temporary cantilevered supports for the next higher row. In this manner, horizontal forces exerted by the cementitious mass are transferred back to the mass.

Verticality of the panels is ensured by a simple adjustment and securing means provided on each strongback, and a personnel safety barrier can be easily provided with a barrier means such as a chain mounted on the stronbacks. Workers are supported by the fill mass behind the panels. Furthermore, the panels are held secure and will not loosen and fall in a high wind.

In another embodiment, brackets partially embedded in the precast panel and coupled to embedded reinforcing members extend outwardly therefrom for the mounting of higher panels, which will then be cantilevered from the lower ones, resulting in an even greater savings in materials, since the embedded brackets and reinforcing members perform the function of the strongbacks.

The face panel apparatus of the present invention includes precast panels which may be constructed of reinforced concrete remote from the job site. Threaded inserts are cast into each panel, to accept tiebacks and strongback mounting bolts. The edges of the panels are made with a tongue and groove or other interlocking edge arrangement, resulting in great security of the structure immediately after panel placement. The exposed face of the panels can be plain or can be given an architectural surface treatment for aesthetic considerations.

BRIEF DESCRIPTION OF THE DRAWINGS

FIG. 1 is a perspective view of a wall erected according to the present invention;

FIG. 2 is a cross-sectional detail taken along line 2—2 of FIG. 1;

FIG. 3 is a perspective view of a single panel with strongbacks mounted thereto;

FIG. 4 is a cross-sectional detail taken along line 4—4 of FIG. 3;

DETAILED DESCRIPTION OF THE DRAWINGS

For illustrative purposes, the present invention will be described with reference to its use in dam construction with a type of roller compacted concrete. Uses in the construction of other types of structures and with alternative fill materials will, of course, be understood to be alternatives which are within the scope of the invention.

Figure 11:
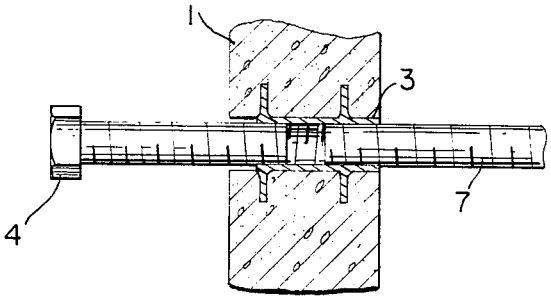
FIG. 11 is a detail showing the tieback rod and strongback mounting means.

Referring to FIGS. 1 through 11, a wall is constructed, according to a first embodiment of the present invention, with individual precast panels 1 of reinforced concrete. Each panel 1 is preferably 16 feet long by 4 feet high by 3½ inches thick, with chamfered edges on its outer face and a tongue and groove configuration 2, best shown in FIG. 2, on its edges, enabling it to securely interlock with surrounding panels. Panels can, of course, be cast in a variety of sizes and shapes as needed for a particular installation to allow, for example, stair-stepping of panels on sloped terrain or curvature in the alignment of the wall. As shown in FIG. 11, threaded inserts 3 are cast into each panel to accept a mounting bolt 4 which secures a strongback 6 to the panel 1. The inserts 3 preferably are recessed about ½" from the front face of panel 1, to allow patching of the hole left behind when the strongback 6 is removed. The inserts also serve as a means for mounting a tieback 7 to the rear face of the panel, as will be described in detail below. In practice, ¾" diameter threaded inserts placed four feet from each side of the panel and two feet three inches from the lower edge of the panel have been found to be best suited for both temporary strongback and permanent tieback securement. If desired, a pair of loop inserts 5 best shown in FIGS. 3, 4 and 9 may be cast into the top edge of the panel to secure lifting apparatus to the panel for greatest ease of handling. The loop inserts 5 will be flush with the edge of the panel to avoid interference with vertically adjacent panels.

Figure 9:
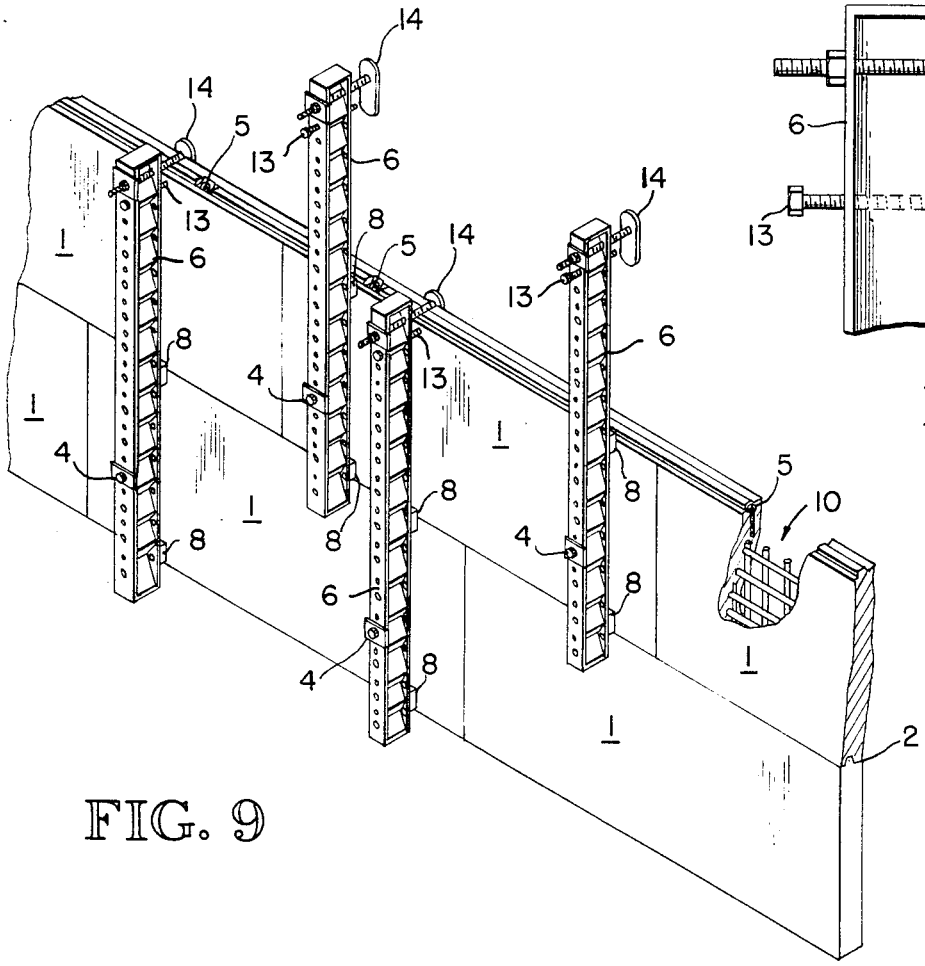
FIG. 9 is a perspective view of two rows of panels before strongback removal.
Figure 10:
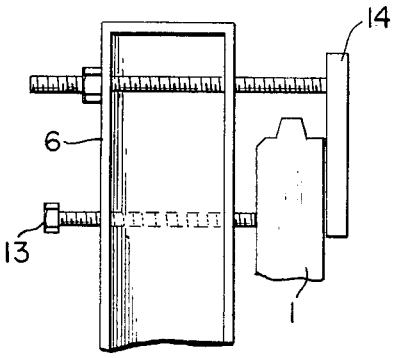
FIG. 10 is a detail of the panel adjustment and securing means on a strongback.
Figure 16:
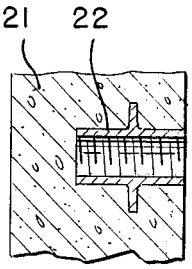
FIG. 16 is a detail of the tieback rod mounting means of the second embodiment.

Reinforcing steel rods 10 are cast into the panel 1 in a manner well known in the art, as shown in FIG. 9. A typical reinforcing arrangement would include eight fifteen and one-half foot horizontal reinforcing rods spaced six inches from each other, and eight three and one-half foot vertical rods. The vertical rods would be positioned about three inches from each end of the panel, three inches on either side of the threaded inserts and about two feet on either side of the center line of the panel. Of course, alternative reinforcing rod configurations can be used, if desired, to fulfill particular requirements regarding panel size, strength, weight and the like.

Figure 5:
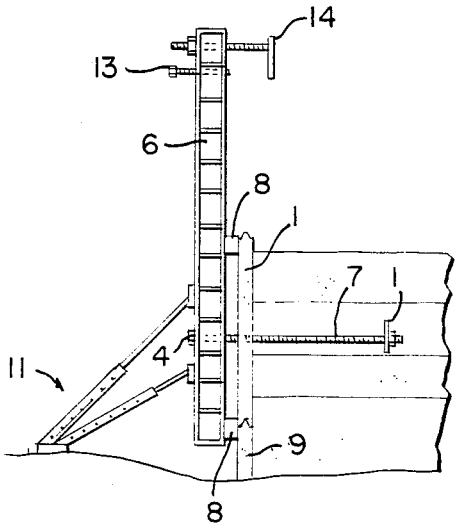
FIGS. 5, 6 and 7 are cross-sectional views showing the sequence of the placing of panels and fill material.
Figure 6:
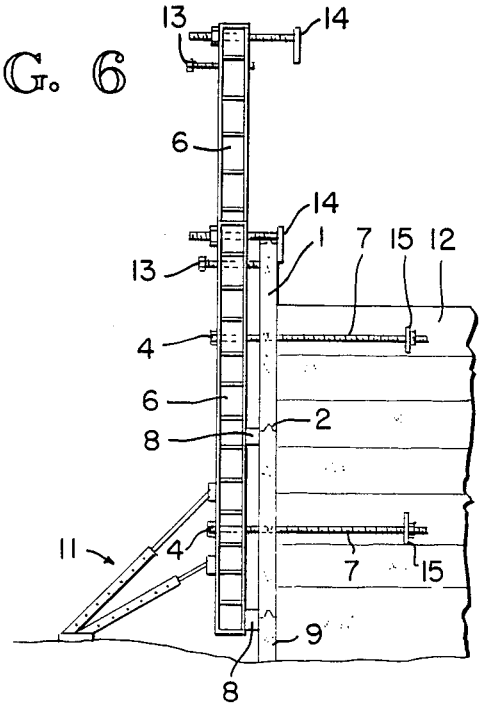
Figure 7:
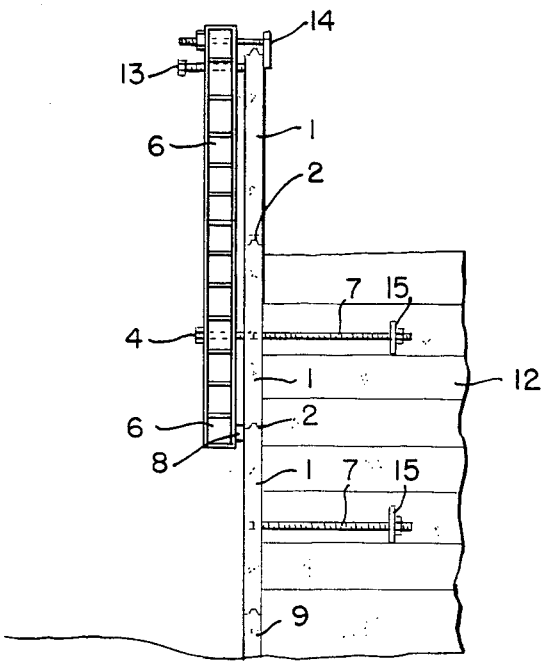

To construct a wall using the panels of the first embodiment, a pair of strongbacks 6 are bolted to each panel 1, as shown in FIG. 3, with wood spacer blocks 8 mounted in the usual manner well known in the art to each strongback to abut the edges of the panel 1. Each strongback 6 is preferably about eight and ¾ feet long, although this length can be varied as needed, for different panel sizes, for example, and is positioned to extend from a point adjacent the lower edge of the panel to a point over four feet above the panel. Referring to FIGS. 5–7, a first row of panels 1 is formed upon a conventional concrete leveling pad 9 and temporarily supported by any means commonly known in the art, such as temporary braces 11 fastened to the strongbacks 6. Half-size panels two feet by sixteen feet, or panels of other sizes, can be used in areas of the wall where the geometry of the base upon which the wall is formed does not allow use of a full-size panel. Then, in the illustrated embodiment, the space behind the panels 1 is filled in with roller compacted concrete 12, preferably in successive lifts of roughly one foot in height. The roller compacted concrete used in this particular embodiment can be defined as a blend of damp gravel fill and cement, with the cement content typically being in the range of 2½ to 7% by weight. It will be understood, of course, that alternative fill materials can be used with the system of the present invention.

The laying of the roller compacted concrete 12 typically entails the material being delivered to the area behind the panels by conveyor, bottom dump trucks, or the like, and then compacted by the passing of a vibratory or other compacting roller over the fill. In this manner, or any desired alternative, successive lifts of roller compacted concrete are built up to approximately the level of the threaded inserts 3. At that point, a pair of tiebacks 7 are threaded into the back of each panel 1 to anchor the panel against the roller compacted concrete 12. In practice, a five-foot long ¾" diameter coil rod with a three-inch square plate washer 15 bolted to one end has been found to be particularly well suited to act as a tieback in the illustrated embodiment. Tieback structure can be modified, of course, for use with different materials or panel structures, the important consideration being that of providing sufficient holding force on the tieback to accomplish its anchoring function. After the securing of the tiebacks 7 in the panels 1, successive lifts of roller compacted concrete 12, or alternative fill material, are again placed behind the panels 1, up to about six inches from the upper edge of the panels.

As explained above, the strongbacks 6 extend upwardly to point over four feet above the upper edge of the panels to which they are bolted. This allows the forming of the second row of panels 1, to be supported by the strongbacks 6 in a unique and novel manner. As shown in FIGS. 6–9, when the roller compacted concrete 12 has sufficiently solidified to secure the first row of panels 1 in position, a second row of panels 1, each having a pair of strongbacks 6 bolted thereto in a manner identical to the first row, is placed on top of the first row of panels 1. The panels in the first and second rows will preferably be staggered in a stacking pattern similar to that commonly used in brick work to eliminate a continuous vertical joint. Joints between panels are left unsealed, allowing water trapped behind the panels to drain.

After placing a panel in the second row, its verticality is adjusted by means of an adjuster bolt 13 and J-bolt 14 passed through the top of each strongback 6, which hold the top edge of the panel 1 securely in the proper position after the panel is plumbed for verticality. Spacer shims can be inserted between vertically adjacent panels if needed to maintain a level horizontal line.

When the second row of panels is formed and secured in place by the adjuster and J-bolts 13 and 14 respectively, successive lifts of roller compacted concrete 12 are laid behind the second row of panels approximately up to the level of the threaded inserts 3 therein. Since the last lift of the concrete 12 behind the first row of panels 1 is six inches below the adjacent edges of the first and second rows, a single lift of roller compacted concrete 12 will span that joint, giving it strength. As before, tiebacks 7 are mounted to the panels 1, and roller compacted concrete 12 is again filled in behind the second row of panels 1 in a manner identical to that used in the preceding row of panels.

Figure 8:
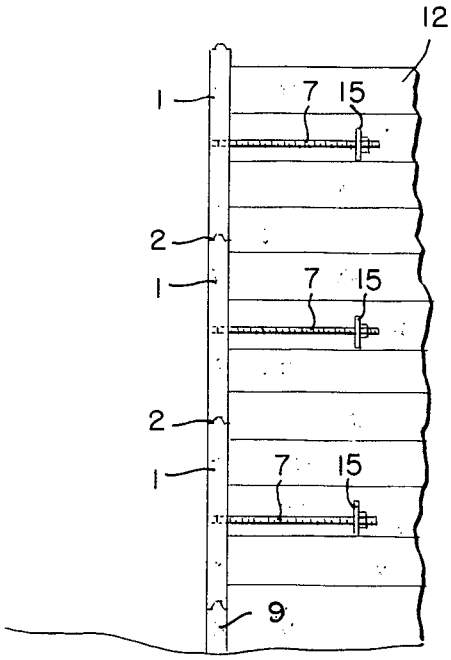
FIG. 8 is a cross-sectional view showing the panels and fill after strongback removal.

After the panels 1 in the second row are sufficiently secure due to adequate solidification of the roller compacted concrete 12, the strongbacks 6 which secure them can then be unbolted from the preceding row at any convenient time, and can then be used in further construction of the wall. FIG. 8 shows a portion of the wall with strongbacks removed. The holes formed by the recessed threaded inserts 3 are then plugged with a bolt or, alternatively, a grouting material in any manner known in the art, leaving a smooth, finished face. If removal of the strongbacks 6 is not yet desired when a succeeding row of panels is to be placed upon the preceding row, the J-bolts 14 securing that preceding row can be loosened and easily moved away from their positions overlying the top edges of the panels. Referring to FIG. 7, succeeding rows of panels can be built upon preceding rows, up to the desired height of the structure in this manner, each row being securely held in a cantilevered fashion by the strongbacks mounted upon the preceding row.

When roller compacted concrete 12 or other material is filled in behind a panel 1, it exerts a lateral force on that panel. This is especially true during the compacting and/or consolidation phase of the fill, when a measurable horizontal force develops. This horizontal force will be collected in the panel 1 and transferred to the strongback 6 which is cantilevered from a lower panel, and which in turn transfers this lateral force back to the fill. Since the lower panel is secured to the cementitious fill to form a part of the monolithic mass through the tiebacks 7, which are designed to resist the tensile force exerted thereon, the structure is sound. Thus, the panels 1, which act as an exterior face for the finished structure, also act as a restraining form for the roller compacted concrete or other fill materials. The outlay of expense, time, materials and labor associated with the use of conventional formwork is significantly reduced by providing a cantilevered support for the precast panels by this novel use of strongbacks 6.

During the setting up of a row of panels, in the illustrated embodiment workers can stand behind the panels 1 upon the roller completed concrete mass, and manipulate the panels 1 and strongbacks 6 from that position. This is also possible with alternative fill materials. If desired, a safety chain, not shown, individually connected between adjacent strongbacks 6 provides an inexpensive and quickly assembled safety barrier.

Figure 12:
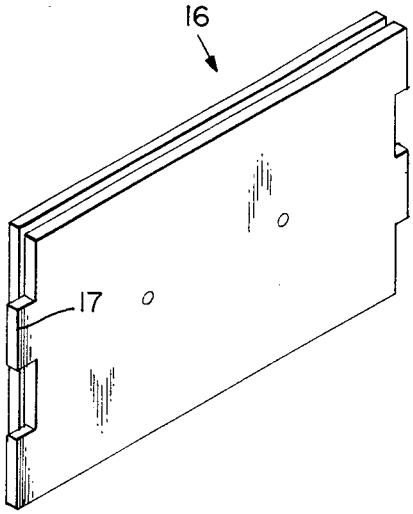
FIG. 12 is a perspective view of a panel showing an alternative interlocking edge configuration.

Referring to FIG. 12, an alternative design for the panel used in the first embodiment features a panel 16 identical to the panel 1 of FIGS. 1–11, except for the interlocking stepped edge configuration 17 on its edges, used as an alternative to tongue and groove type edges. This alternative interlock arrangement may be desirable in certain applications, and it will, of course, be understood that alternative interlocking edge configurations other than the tongue and groove or stepped edge are within the scope of the invention.

Referring now to FIGS. 13–16, a second embodiment of the invention features panels 21 cast in concrete and preferably reinforced with steel rods in a manner similar to the previously described embodiment. A pair of threaded inserts 22, shown in detail in FIG. 16, positioned as in the first embodiment or in any acceptable alternate manner extend from the back of the panel 21 half-way through the panel to accept threaded tieback rods as in the first-described embodiment.

Figure 14:
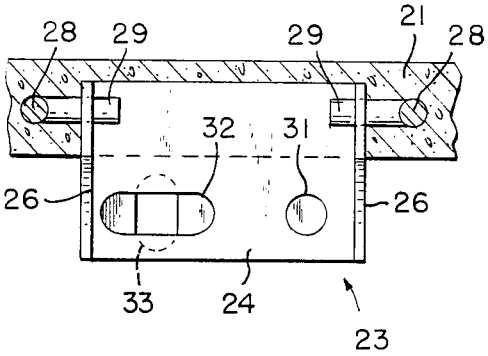
FIG. 14 is a cross-section taken along line 14—14 of FIG. 13.
Figure 13:
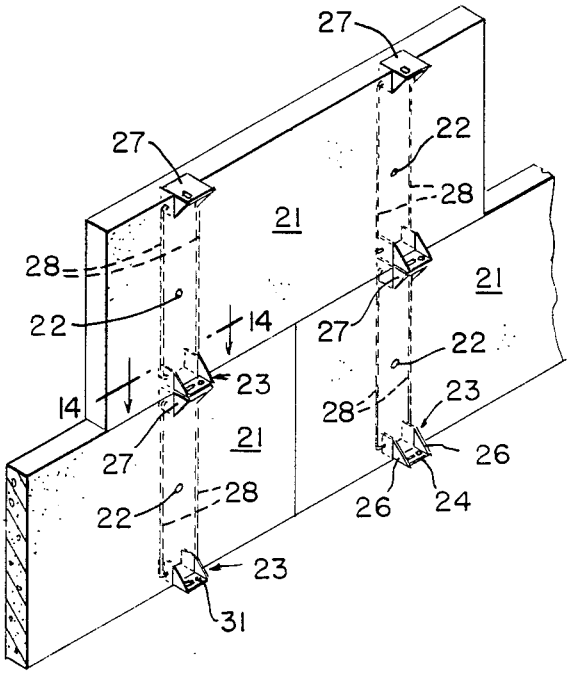
FIG. 13 is a perspective view of three panels joined together according to a second embodiment of the invention.
Figure 15:
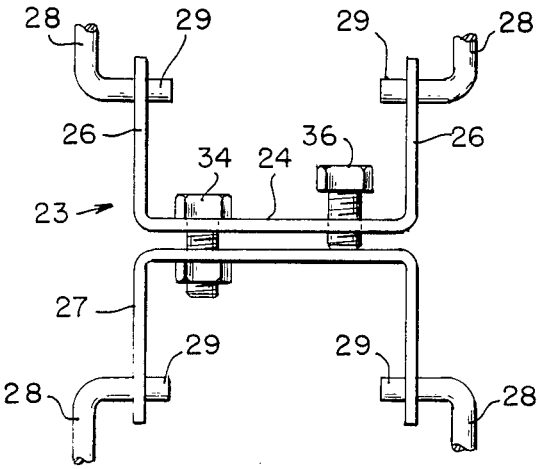
FIG. 15 is a detail of the verticality adjustment means of the second embodiment.

A pair of U-shaped brackets 23, each having a plate 24 extending between two uprights 26 are partially embedded in the panel 21 along its lower edge preferably about four feet from either end. Each bracket 23 has its plate 24 flush with the edge of the panel 21 and extending out from the back face of the panel 21, with its uprights 26 deeply embedded in the panel 21. A similar part of brackets 27 are embedded in the upper edge of each panel 21 directly across from lower brackets 23. Each lower bracket 23 is coupled to its corresponding upper bracket 27 by a pair of vertical steel tension reinforcing rods 28 inside the panel 21 having horizontal end portions 29 inserted through the uprights on each bracket. It will be understood, of course, that variations from the details of the illustrated embodiment can be made to meet the needs presented in a particular application of the system. In use, roller compacted concrete is placed behind rows of panels 21 and tiebacks secured to the panels 21, in a manner similar to that described in connection with the first embodiment. Alternative fill materials can also be utilized with this embodiment. The panels 21 in this second embodiment are not supported by strongbacks as in the first embodiment, but are directly cantilevered from lower panels and permanently fastened thereto by the brackets 23 and 27. Referring to FIGS. 14 and 15, a threaded bolt-receiving hole 31 and longitudinal slot 32 are preferably provided on the outwardly extending portion of plate 24 on each lower bracket 23, and a transverse slot 33 is provided on each upper bracket 27 so that two vertically adjacent panels 21 can be fastened together as shown in FIG. 15 by a bolt 34 passing through both the longitudinal and transverse slots 32 and 33. Because each panel 21 is thus securely fastened to surrounding panels, an interlocking tongue and groove configuration in panel edges is unnecessary. Use of slots in the brackets has been found to be preferable because it eliminates the need for exact horizontal alignment of the panels. A second bolt 36 through threaded hole 31 and bearing on the plate portion of the upper bracket 27 on the vertically adjacent panel cooperates with first bolt 34 to allow vertical adjustment of adjacent panels 21, with the first bolt 34 acting in tension and the second bolt 36 acting in compression between the two vertically adjacent panels. This arrangement is advantageous because of its low cost and simple operation. However, any suitable means for fastening and adjusting adjacent panels can be used.

The illustrated structure of the upright portions of the brackets 23 and 27 is advantageous since the uprights act as reinforcing webs to prevent bending of the brackets, and the tension reinforcing rods 28 hold the brackets securely in position, preventing them from being torn out of the panel. In addition to assuring the integrity of the brackets, the internal reinforcing rods resist cantilever forces, allowing the uppermost row of panels to restrain the cementitious material and the lateral forces generated by its placement. Thus, a secure face panel system can be erected, with the only necessary materials being the panels 21 themselves and bolts 34 and 36, resulting in a tremendous savings.

Although the invention has been described with reference to two specific embodiments used in particular illustrative structures, modifications to these embodiments and the structures in which they are used can be made without departing from the scope of the invention.

What is claimed is:

1. A method of constructing a panel-faced fill structure comprising the steps of:

placing successive rows of exposed substantially vertical panel members to form the permanent exposed panel face of said fill structure;

placing a back fill mass against one surface of said successive rows of panels at the rows are placed;

anchoring each of said panels with tieback members extending into the back fill mass of said structure as the successive rows are placed; and supporting each successive row of panels against the lateral shear and overturning forces of said back fill mass by means of supports cantilevered from the preceding row until said tieback members are held by said back fill mass.

2. A method for constructing a fill structure comprising the steps of:

placing a generally horizontal first row of substantially vertical panels;

back filling a fill mass against one substantially vertical surface of the panels of said first row, said first row of panels providing a facing form for said fill mass;

vertically supporting a second generally horizontal row of substantially vertical panels upon said first row, one of the substantially vertical surfaces thereof being substantially coplanar with said one surface of said first row;

securing said second row of panels against lateral shear and overturning forces acting against the said one surface thereof with support members cantilevered from said first row;

then continuing the back filling of said fill mass against the one surface of said second row; and repeating the placement and support of succeeding rows of panels to form a permanent exposed panel face of said fill structure and back filling until the structure has reached a predetermined height.

3. The method of claim 2 including the step of:

anchoring each panel of each said successive row with tieback members extending from said panels into said fill mass.

4. The method of claim 3 wherein said cantilevered support members are mounted to the substantially vertical surface of the panels of the first row opposite said one surface thereof and including the step of removing said cantilevered support members from the panels of the first row after the panels of the second row are anchored.

5. The method of claim 3 wherein the step of anchoring each panel with tieback members includes the steps of threadedly securing the tieback members in said panels.

6. The method of claim 2 wherein the support members are at least partially embedded in said panels and wherein the step of securing said second row of panels includes the step of coupling said panels in said second row to said panels in said first row along their adjacent horizontal edges.

7. A method for constructing a fill structure comprising the steps of:

placing a first substantially horizontal row of panels, said panels having an exposed face and a fill contacting face;

cantilevering support members from the exposed face of said panels with the cantilevered support members extending substantially vertically upward;

back filling a fill mass against the fill contacting face of said panels in said horizontal row;

extending a plurality of tiebacks from the panels into the fill mass;

placing a substantially horizontal second row of panels upon the first row, said second row being supported against laterally directed shear and overturning forces by the cantilevered support members; and repeating the steps of cantilevering support members, backfilling, extending tiebacks, and placing rows of panels to form a permanent exposed panel face of said fill structure until the structure reaches a predetermined height.

8. A panel for use in constructing a panel-faced fill structure comprising:

a concrete planar surface;

a pair of brackets extending from opposite edges of the surface for connecting said panel to adjacent panels by coupling with brackets on said adjacent panels;

means mounted on the pair of brackets and embedded in the panel for forming a cantilever support means when one of said brackets is coupled with a bracket on an adjacent panel; and means for anchoring said panel against a fill mass.

9. The panel of claim 8 further comprising means mounted to the brackets for adjusting the relative positions of adjacent coupled panels.

10. The panel of claim 8 wherein the means for forming a cantilever support means includes a rod member embedded in and extending across said panel between said pair of brackets, and having each end fastened to one bracket respectively of said pair in close proximity to the edges of said panel.

11. A face panel system for a fill structure comprising:

successive horizontal rows of substantially vertical panels, the front faces thereof forming an exposed permanent wall face for said fill structure;

a fill mass extending against said panels on the opposite faces thereof;

tieback tension members embedded in said fill mass and connected to said panels; and cantilevered support members for coupling the panels together as they are placed in said successive rows, for restraining the lateral shear and overturning forces of said fill mass against said panels as it is placed and until said tieback members are held by said fill mass.

12. The face panel system of claim 11 wherein said cantilevered support members are embedded in said panels.

13. The face panel system of claim 11 wherein said cantilevered support members include support members mounted to said front face of said panels and wherein said support members are removed therefrom after said tieback members are held by said fill mass.

* * * * *